US005138780A

United States Patent [19]

Kunkel

[11] Patent Number: 5,138,780

[45] Date of Patent: Aug. 18, 1992

[54] IMMOVABLE WALL MOUNTED PICTURE FRAME

[76] Inventor: Edmund Kunkel, 19118 Stillmore St., Canyon Country, Calif. 91351

[21] Appl. No.: 608,171

[22] Filed: Oct. 31, 1990

[51] Int. Cl.[5] ..... G09F 1/12

[52] U.S. Cl. ..... 40/152

[58] Field of Search ..... 40/152, 152.1, 584, 40/611, 649, 593; 248/489, 475.1

[56] References Cited

U.S. PATENT DOCUMENTS

| | | | |
|---|---|---|---|
| 1,175,652 | 3/1916 | Marquette | 40/649 |
| 1,521,617 | 1/1925 | Griesbach | 40/649 |
| 1,541,354 | 6/1925 | Harrison | 40/152.1 X |
| 2,297,574 | 9/1942 | McCord | 40/611 |
| 4,976,055 | 12/1990 | Kane | 40/152.1 |

FOREIGN PATENT DOCUMENTS

| | | | |
|---|---|---|---|
| 559511 | 7/1958 | Canada | 248/489 |
| 610679 | 10/1948 | United Kingdom | 40/152 |

*Primary Examiner*—Kenneth J. Dorner
*Assistant Examiner*—J. Bonifanti
*Attorney, Agent, or Firm*—Roger A. Marrs

[57] ABSTRACT

A wall mounted frame is disclosed herein for insertably receiving and holding a picture including protective sheets such as glass and cardboard backing which includes top and bottom members joined by side members so as to define a display space or area intended to be occupied by the picture. The members include a continuous slot engageable with the edge marginal region of the protective sheets while the slot of the top member is open for slidably passing the picture and protective sheets into and out of the frame. A mounting bar is secured to the back of the frame extending across the display space or area between the opposite side members. The bar is provided a central mounting open for receiving a wall mounting nail, screw or the like and an off-center opening is provided for receiving a lateral stabilizing fastener.

1 Claim, 1 Drawing Sheet

IMMOVABLE WALL MOUNTED PICTURE FRAME

BACKGROUND OF THE INVENTION

1. Field of the Invention

The present invention relates to the field of picture frames or holders, and more particularly to a novel frame for holding and displaying a picture on a vertical wall surface which permits the frame to be mounted in a flush relationship with respect to the wall and which further includes centering means to prevent lateral or off-center mounting of the frame on the wall.

2. Brief Description of the Prior Art

In the past, it has been the conventional practice to place a picture, including protective sheets, such as cardboard material, glass or the like in a frame which is mounted against the surface of a vertical wall. In such mounting, a nail, hook or the like is initially installed on the wall surface and a flexible wire or toothed rigid fixture carried on the back of the picture frame is hooked or coupled to the wall mounting. When flexible wires are employed, centering of the picture is quite difficult and any slight encounter with the frame after subsequent mounting oftentimes results in an offset of the frame. When employing the toothed bar, the bar or mounting is generally projecting rearwardly from the back of the frame and it is difficult to visually place the selected tooth on the bar over the mounting nail or hook. Also, in both the rigid bar and wire mounts, a substantial space results between the back of the frame and the vertical wall which is unsightly. Also, these mountings oftentimes release or permit disassembly of the frame from the wall mounting during extraordinary shaking caused by earthquakes or the like.

Therefore, a long-standing need has existed to provide a novel means for mounting a picture frame onto a vertical wall surface, which eliminates the undesired space between the back of the frame and the surface and which permits lateral stabilization of the frame so that off-center mounting is avoided.

SUMMARY OF THE INVENTION

Accordingly, the above problems and difficulties are obviated by providing a novel frame having a central display case or area defined between the opposing surfaces or sides of frame members composed of vertical side members joined at their opposite ends to respective top and bottom members. Each of the respective members includes a slot opening to the display area so that the slots of the respective members face one another. The slot carried on the top member is open through both the top and the bottom of the top member in order to slidably receive a picture and its protective sheets, such as cushion material, cardboard or glass in such a manner that the edge marginal regions of the protective sheet are nested within the slots of all of the frame members. A mounting bar having its opposite ends secured to the respective side members of the frame is carried on the back side of the frame and a central opening is provided in the middle of the bar so as to receive a mounting fastener, such as a nail, screw or hook. The mounting bar will be flush against the vertical surface of a wall and an offset hole or opening is provided for receiving a stabilizing fastener to prevent lateral pivoting, movement or displacement of the frame from its properly mounted position by the central fastener.

It is among the primary objects of the present invention to provide a novel picture frame having a mounting means for permitting the frame to be mounted flush against a vertical wall surface.

Another object of the present invention is to provide novel mounting means for a picture frame which not only permits a squared or selective position of the frame to be placed on a vertical wall surface but provides a stabilizing means to prevent displacement of the frame from its installed position.

Another object of the present invention is to provide an inexpensive picture frame whereby the picture and its protective sheets may be inserted into the frame after the frame has been mounted against the surface of a vertical wall.

Still another object of the present invention is to provide a means for slidably receiving a picture and its protective sheets within a mounting frame that is mounted in a flush position against the surface of a wall and which further includes an offset mounting means for maintaining the frame in its initial and selective mounting position.

Still a further object of the present invention is to provide a novel mounting means for a picture frame which will not dislodge the picture or the frame from its mounted position on a vertical wall during earthquake conditions or the like.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
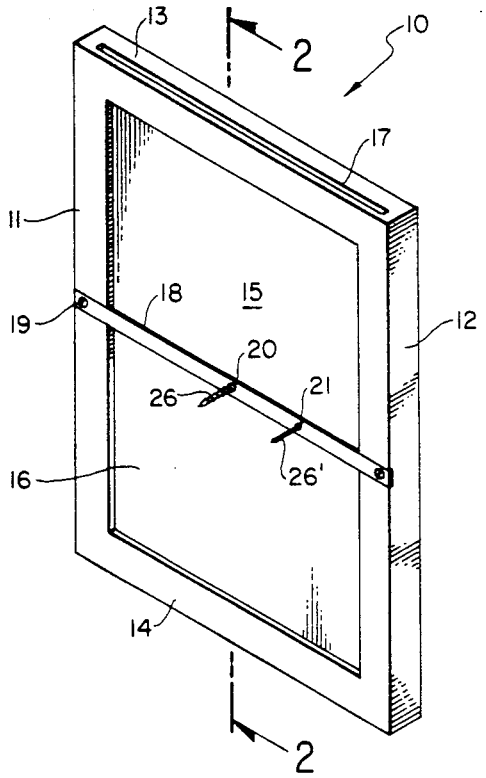
FIG. 1 a rear perspective view of the novel picture frame incorporating the present invention.

Referring to FIG. 1, the novel picture frame of the present invention is illustrated in the general direction of arrow 10 which includes a frame defined by opposite side members 11 and 12 which are joined at their opposite ends to the opposite ends of a top member 13 and a lower or bottom member 14. The opposing surfaces or sides of the frame members define a central space or area 15 which may be considered a display area into which a suitable picture and protective sheets, such as cardboard, cushion material and glass may be disposed. In the view of FIG. 1, the rear of the frame is illustrated and the protective sheet which may be of cardboard or the like is indicated by numeral 16. The top member 13 includes an elongated slot having an entrance 17 leading into the display area 15. The opening leading into the slot indicated by numeral 17 insertably receives the picture and the protective sheets during the installation of the frame on a vertical wall. To maintain the frame on a vertical wall surface, a mounting bar 18 is provided which is fastened at its aligned recesses, 29 in the side members 11 and 12 respectively by means of conventional fasteners, such as screws 19. It is to be particularly noted that the center of the mounting bar 18 includes an aperture or opening 20 through which a mounting screw or mounting hook is disposed for retaining the frame against the wall surface in a flush manner. Furthermore, the mounting bar includes a hole or opening 21 which is offset from the central opening 20 in order to receive a nail or other fastener in support of the frame so as to prevent pivoting or tilting of the frame about the central fastener through the hole 20. Therefore, the stabilizing or offset hole 21 stabilizes the frame to the wall surface.

Figure 2:
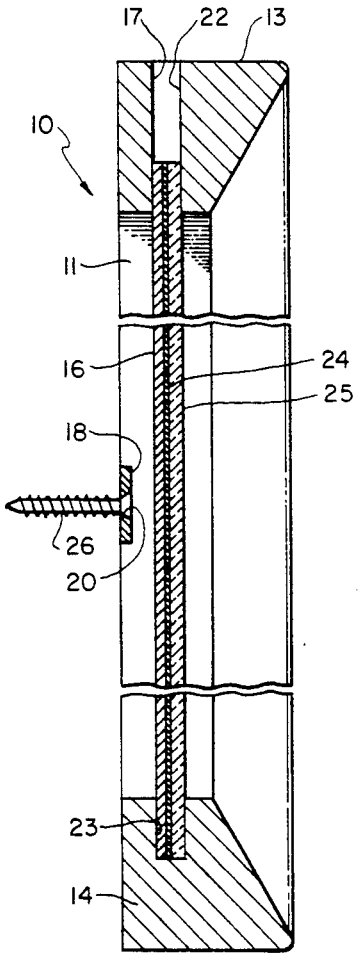
FIG. 2 is an enlarged transverse cross-sectional view of the picture frame shown in FIG. 1 as taken in the direction of arrows 2—2 thereof.

Referring now in detail to FIG. 2, it can be seen that the entrance 17 leads into a slot 22 that is in registry and index with slots provided on the inside surface of side members 11 and 12 as well as bottom member 14. The slot shown in bottom member 14 is indicated by numeral 23 and it can be seen that the edge marginal peripheral region of the combined picture and protective sheets are carried within the continuous slots provided by the frame members 11–14 inclusive. A picture is indicated by numeral 24 and a sheet of protective glass is indicated by numeral 25. The mounting screw or fastener passing through hole 20 is indicated by numeral 26 and it is to be noted that the central opening 20 is countersunk in order to ensure that the head of the fastener be flush with the surface of the mounting bar.

Figure 3:
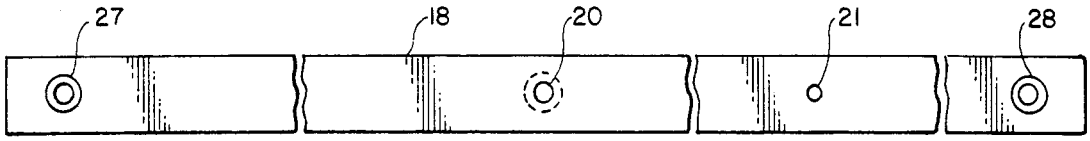
FIG. 3 an enlarged front elevational view of the mounting bar employed in the picture frame illustrated in FIGS. 1 and 2.

Referring now in detail to FIG. 3, the mounting bar is more clearly illustrated in which the opposite ends of the bar include countersunk holes 27 and 28 for insertably receiving screws or other fasteners for holding the bar to the side members 11 and 12. The central opening 20 is strategically located midway between the opposite ends of the bar and the stabilizing hole or opening 21 is illustrated offset from the central opening 20 such as in a location between the opening 20 and the opening 28.

In view of the foregoing, it can be seen that the novel picture frame of the present invention may be mounted directly to the wall surface of a vertical wall in a flush manner where the rear of the frame members may substantially engage with the wall surface. With the picture and protective sheets removed via the open top member slot 22, access is had to the central mounting hole or opening 20 so that the user may insert fastener 26 through the opening and install the fastener into the wall. When the fastener is suitably tightened, the frame 10 will remain in a flush mounted condition against the vertical wall surface. If desired, the offset hole 21 may receive the stabilizing fastener so that rotation or twisting of the fastener is prevented. Once the mounting bar and the frame have been secured to the wall surface, the picture and protective sheets may be inserted through entrance 17 into the slot 22 and conducted through the registered slots in the side members 11 and 12 to where the picture and protective sheets will bottom in slot 23 carried in the bottom member 14. The ornamental or graphic rendering on the picture 24 will be visible through the protective glass 25 for view as framed by the frame members. The peripheral edge marginal regions of the picture and protective sheets are engaged within the respective slots of the frame members so that the picture and protective sheets are firmly held in position. Therefore, no jarring of the frame nor of the wall structure itself, such as during an earthquake, will dislodge the frame from its mounting on the wall.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A picture frame for removably holding a picture and protective sheets comprising the combination of:

a continuous frame having opposite side members connected together at their opposite ends by top and bottom members respectively;

said frame members defining a central display area between opposite frame members;

said side members provided with aligned recesses separated by said display area;

a mounting bar having its opposite ends secured to said side members within said recesses across said display area midway between said top member and said bottom member whereby said frame members and said mounting bar provide a flush rear surface;

a center mounting hole in said mounting bar midway between its opposite ends substantially at the center of said central display area;

said mounting bar further includes a stabilizing hole offset from said center mounting hole in communication with said display area for receiving a stabilization fastener;

a top member slot provided in said top member being an open-ended slot having an entrance leading exteriorly of said frame and communicating with said central display area;

said mounting bar hole is countersunk to provide flush mounting of said hanger fastener;

said frame includes a rear side flush with a vertical wall hanging surface;

a picture disposed between protective sheets having a peripheral edge marginal region engaged within said member slots; and said picture and protective sheets slidably movable through said top member slot.

* * * * *